United States Patent [19]

Richter

[11] Patent Number: 4,522,319

[45] Date of Patent: Jun. 11, 1985

[54] RETENTION DEVICE FOR FLOW RATE CONTROL TUBE WITHIN A DISCHARGE CONTAINER

[75] Inventor: Simon J. Richter, Marietta, Ga.

[73] Assignee: The Coca-Cola Company, Atlanta, Ga.

[21] Appl. No.: 504,865

[22] Filed: Jun. 16, 1983

[51] Int. Cl.[3] ..... B67D 3/00

[52] U.S. Cl. ..... 222/481.5; 222/541

[58] Field of Search ..... 222/481.5, 541, 211, 222/482, 564, 71

[56] References Cited

U.S. PATENT DOCUMENTS 1,513,935 11/1924 Schatz ..... 222/541.5 X
2,188,402 1/1940 Feis ..... 222/481.5 X
3,454,196 7/1969 Hazard ..... 222/541 X
4,328,909 5/1982 Jeans ..... 222/481.5 X

*Primary Examiner*—Stanley H. Tollberg
*Attorney, Agent, or Firm*—Birch, Stewart, Kolasch & Birch

[57] ABSTRACT

A container for dispensing syrup in a post-mix beverage dispenser including a flow rate control tube with a first open end vented to the atmosphere through the container bottom and a second open end of the tube disposed at a selected distance above a discharge opening of the container. The second open end of the container is retained in a socket laterally offset from the discharge opening, so that the container may be filled with syrup through the discharge opening without interference from the second open end of the tube.

10 Claims, 5 Drawing Figures

RETENTION DEVICE FOR FLOW RATE CONTROL TUBE WITHIN A DISCHARGE CONTAINER

BACKGROUND OF THE INVENTION

The present invention relates to a disposable package for dispensing liquids with a controlled rate of flow. More specifically, the present invention relates to a disposable syrup package for a post-mix softdrink dispenser having a flow rate control tube secured within the syrup container.

An exemplary prior art syrup package is disclosed in U.S. Pat. No. 4,216,885 to Sedam, issued Aug. 12, 1980 and assigned to the same assignee as the present invention. In the syrup package described in the Sedam Patent, the flow rate control tube 18 has an open end 18A therein at a predetermined distance above the discharge opening of container 12 and in alignment therewith. Although this location of open end 18A works quite well for dispensing liquids from a container 12 at the desired controlled rate of flow, this position may interfere with the filling operations of the container. For example, if container 12 is filled by inserting a filling head into container 12 through the discharge opening, the filling head may be obstructed by tube end 18A. This could interfere with the filling operation; cause damage to the tube 18; or cause the liquid, such as syrup, to flow up the tube. Since all of these contingencies are undesirable, a need in the art exists for a package construction which offsets the position of tube end 18A from alignment with the discharge opening, while at the same time permits tube 18 to control the rate of flow from container 12 in accordance with the teachings of the Sedam Patent.

SUMMARY OF THE INVENTION

Accordingly, it is a primary object of the present invention to provide a container for dispensing liquids at a controlled rate of flow by means of a flow rate control tube properly positioned to control flow rate, but offset from the discharge opening of said container at a sufficient distance so that it does not interfere with the filling of said container through the discharge opening.

It is further object of the present invention to provide a socket structure formed in a sidewall portion of a container, offset from the discharge opening which permits an open end of a flow rate control tube to be readily inserted therein through an aperture in the container bottom, but which will not permit any substantial lateral movement of said open end once it is seated in that socket.

It is a further object of the present invention to provide a disposable package for dispensing liquids with a controlled rate of flow, which is completely assembled at the time of shipping and requires no adjustment on the part of the user at the point of use.

It is another object of the present invention to provide a light weight disposable package for dispensing liquids, including means for preventing damage to the package during shipping.

It is still another object of the present invention to provide a disposable package for dispensing liquids with a controlled rate of flow which is light weight and inexpensive to manufacture.

The objects of the present invention are fulfilled by providing a package for dispensing liquids with a controlled rate of flow comprising:

a container having a closed end and a discharge end defining a discharge opening through which liquids may be dispensed;

a flow rate control tube having first and second open ends, the tube extending substantially longitudinally of said container with the first open end of said tube extending through said closed end of said container and said second open end disposed within said container at a predetermined distance from said discharge opening to control the flow rate of liquid through said discharge opening; and retention means for retaining said open end of said tube at a predetermined position laterally offset from said discharge opening;

whereby said container may be filled with liquid through said discharge opening without interference from said second open end.

The retention means in a preferred embodiment comprises a socket formed in the wall of said container, said socket being configured to retain the second open end of said tube therein. More specifically, the configuration of the socket in a cross section of said container wall taken orthogonally to a longitudinal axis of the container defines a retention opening larger than the external cross-sectional dimension of said flow rate control tube and an adjoining slot providing fluid communication between the retention opening and the discharge opening. The slot is more narrow or of a lesser dimension than the external cross-sectional dimension of the flow rate control tube, and thereby precludes the passage of the tube laterally therethrough.

The container of the present invention has a main body portion which tapers towards a neck portion, which includes the discharge opening. The neck portion may be provided with a manual gripping ring, and in a preferred embodiment, the retension socket of the present invention is formed within a peripheral portion of that gripping ring.

In operation with a conventional post-mix syrup dispenser, the plastic bottle or syrup package of the present invention is inverted and inserted into the valve seat of the dispenser against a sharp piercing device. The piercing device ruptures a membrane extending across the open end of the syrup container to form a dispensing outlet. The first openable end of the flow rate control tube extending through the bottom of the container to the atmosphere is then opened to permit the flow of air into the tube. A pressure balance is then created within the bottle as the liquid is withdrawn and replaced by air, and from this point on, the tube in the syrup container functions to control the rate of flow of syrup at a substantially constant rate as the contents of the bottle are dispensed. This operation is completely described in connection with the aforementioned Sedam U.S. Pat. No. 4,216,885, and the disclosure of that Patent to the extent that it is necessary to a complete understanding of the present invention is incorporated herein by reference.

BRIEF DESCRIPTION OF THE DRAWINGS

The objects of the present invention and the attendant advantages thereof will become more readily apparent by reference to the accompanying drawings, wherein.

DETAILED DESCRIPTION OF THE DRAWINGS

Figure 1:
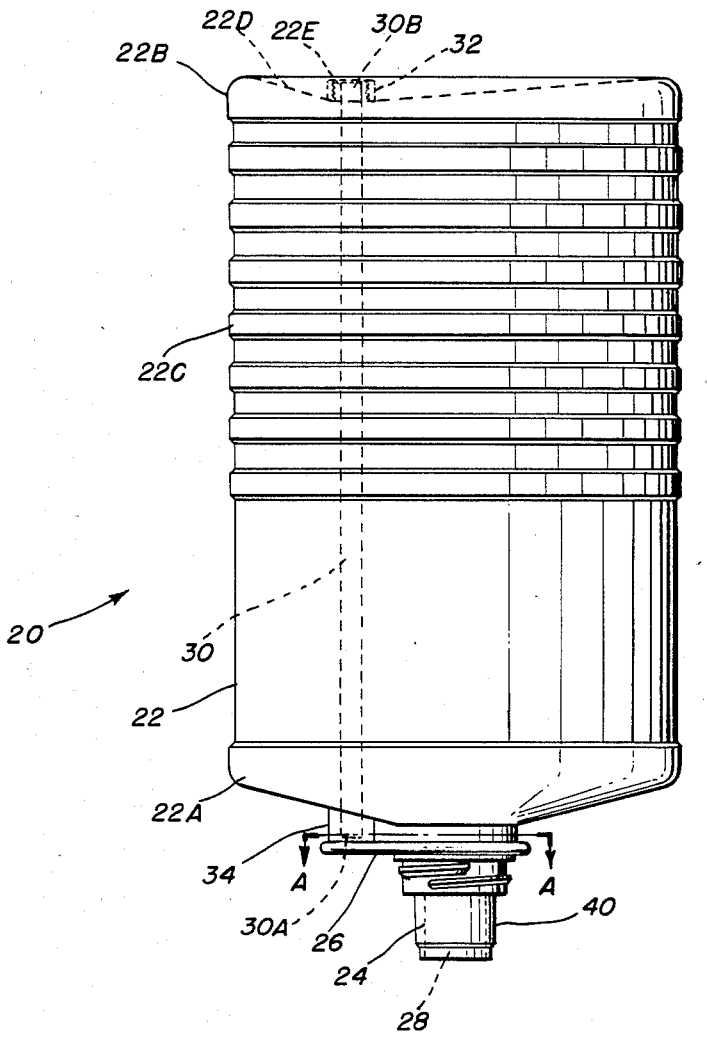
FIG. 1 is a side elevational view of a syrup package of the present invention illustrated in the inverted position that it would occupy when connected to a post-mix beverage dispenser.

Referring to FIG. 1, there is generally indicated a syrup package 20, including as its main component a generally cylindrical container 22 having a closed end 22B and an opposite end 22A, terminating in a neck portion 24 with a discharge opening 28 therein. Container 22 is preferably plastic and is manufactured using pressure-resistant synthetic resins, such as PET (polyethylene terephthalate), PVC (polyvinyl chloride resin), PE (polyethylene), PS (polystyrene), PP (polypropylene), PVPC (polyvinylidene chloride), etc. Production of the container 22 from PET (polyethylene terephthalate) by blow molding is preferred.

The container 22 has a main body portion which is generally cylindrical and has molded thereinto a plurality of strengthening ribs 22C from approximately the mid point of the body portion to the bottom of the container 22B. These strengthening ribs are provided to resist collapse of the container due to negative pressures therein.

A flow rate control tube 30 is disposed within container 22. Flow rate control tube 30 has a first openable end 30B extending through an aperture in container end 22B, defined by a neck portion 22E. A second open end of flow rate control tube 30 is designated 30A and is located within container 22 at a predetermined distance above discharge opening 28. Open end 30A is also offset laterally, as viewed in FIG. 1, from the discharge opening 28 to preclude interference with container filling heads which may be inserted through opening 28 during the introduction of liquid into the container. Accordingly, end 30B of tube 30, which communicates with the atmosphere through the bottom 22B of container 22, when opened, provides atmospheric pressure within the container at the position of open end 30A.

In accordance with the present invention, a socket 34 is provided in the wall of container 22 within an optional gripping ring 26 for the purpose of retaining end 30A of tube 30 in a laterally offset position from discharge opening 28. The preferred shape of socket 34 is best illustrated in the cross-sectional view of FIG. 4, taken along lines A—A of FIG. 1. It can be seen that in this cross-sectional view, socket 34 is configured to include a retention opening 34A in which tube end 30A is seated, and a slot portion 34B providing fluid communication between retention opening 34A and the interior of the container adjacent the discharge opening 28. The retention opening 34A is dimensioned to be larger than the external dimensions of tube 30, to permit some lateral movement therein. This is important during the assembly of the package of the present invention, since the tube 30 is automatically inserted by suitable machinery during mass production through the aperture defined by bottom neck 22E. Therefore, the tolerances illustrated between the dimensions of tube 30 and retention opening 34A provide some margin of error for direction tube 30 longitudinally through the bottom of the container until end 30A seats within opening 34A. On the other hand, slot 34B is more narrow or of a lesser dimension than the external diameter of tube 30, and, therefore, lateral movement of tube end 30A through slot 34B is not possible.

Accordingly, tube end 30A is seated within socket 34 at the proper position above discharge opening 28, as illustrated in FIG. 1, but is laterally offset from the discharge opening so that the insertion of filling heads or similar apparatus through the discharge opening during filling of container 22 will not interfere with the tube end 30A of flow rate control tube 30.

Figure 2:
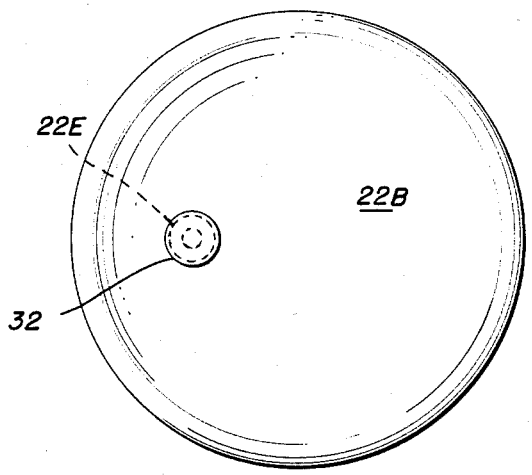
FIG. 2 is a plan view of the container bottom of FIG. 1, that is, the end of the container of FIG. 1 which occupies the top position of the elevational view of the inverted container.
Figure 3:
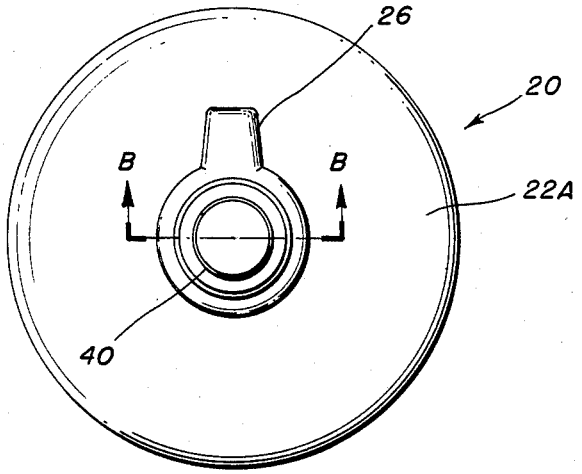
FIG. 3 is a plan view of the discharge end of the container of FIG. 1, namely, the bottom end of the container as viewed in FIG. 1.

Referring to FIG. 2, the details of the bottom 22B of container 22 are illustrated. That is, the end 22B of container 22 which occupies the top position of the inverted container of FIG. 1. As stated before, an aperture is provided in the bottom 22B within a neck portion 22E, which retains the open end 30B of tube 30. Neck 22E may be provided on its peripheral surface with threads for receiving a screw cap 32 thereon. This screw cap would be positioned on neck 22E during filling operations of the container at a syrup plant, and during shipping of the container to the point of use. However, once the syrup container is inverted and inserted into a post-mix beverage dispenser, cap 32 is unscrewed to provide atmospheric pressure through tube 30 to open end 30A within socket 34. In the alternative, cap 32 could be replaced by a frangible cover over tube end 30B or tube end 30B could be formed with an integral, rupturable plastic end.

Container end 22B may also be provided with corrugations for strengthening purposes, as illustrated. Also, the neck 22E and associated screw cap 32 surrounding tube end 30B are all recessed within a concavity 22D in end 22B. This concavity helps prevent damage to tube end 30B, neck 22E or end cap 32 during shipping or use preparatory to insertion into a post-mix beverage dispensing machine.

Figure 4:
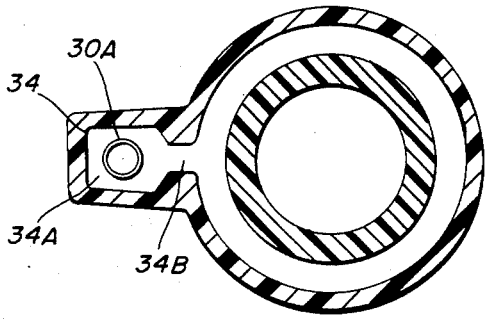
FIG. 4 is an enlarged cross-sectional view taken along lines A—A of the container of FIG. 1.
Figure 5:
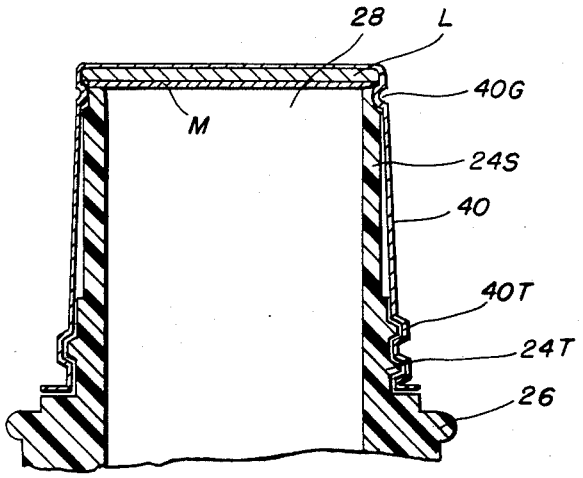
FIG. 5 is an enlarged side cross-sectional view of the container cap and neck portion taken along lines B—B of FIG. 3.

Details of the neck portion of the container 22 of the present invention are illustrated in FIG. 5. The neck portion includes a gripping ring 26 in which the socket 34 of the present invention is disposed. This location of socket 34 is best illustrated in FIGS. 1 and 4 described hereinbefore. Just above the gripping ring 26 are threads 24T, which are operatively associated with threads 40T on a protective cap 40, to be disposed over the discharge opening 28, defined by the container neck 24. The cap or closure 40 has a molded-in liner retention feature for liner L. This is provided by a liner retention groove 40G. As can be seen in FIG. 5, this liner retention groove 40G not only holds liner L within cap 40, but seats within a recess in the end of container spout 24S. This recess in spout 24S can also serve as a pilot for inserting the spout in the dispensing valve socket of a post-mix beverage dispensing machine. As further illustrated in FIG. 5, the discharge opening 28 may be covered by a frangible membrane M, which may be adhesively secured by heat sealing around the rim of discharge spout 24S to cover discharge opening 28. In the event that a frangible membrane M is utilized, it will be punctured by suitable means in the socket of the dispensing valve of the post-mix beverage dispenser, such as illustrated in the aforementioned U.S. Patent to Sedam.

It should be understood that the syrup package described hereinbefore may be modified as would occur to one of ordinary skill in the art without departing from the spirit and scope of the present invention.

What is claimed is:

1. A package for dispensing liquids with a controlled rate of flow comprising:

a container having a closed end and a discharge end defining a discharge opening through which liquids may be dispensed;

a flow rate control tube having first and second open ends, the tube extending substantially longitudinally of said container with the first open end of said tube extending through said closed end of said container and said second open end disposed within said container at a predetermined distance from said discharge opening to control the flow rate of liquid through said discharge opening; and retention means for retaining said second open end of said tube at a predetermined position laterally offset from said discharge opening, said retention means including a socket in the wall of said container, said socket being configured to retain the open end of said tube therein;

whereby said container may be filled with liquid through said discharge opening without interference from said second open end.

2. The package of claim 1, wherein the configuration of said socket in a cross section of said container wall taken orthogonally to a longitudinal axis of said container, defines a retention opening larger than the external cross-sectional dimension of said tube in which said second open end is retained, and a slot providing fluid communication between said retention opening and said discharge opening, said slot being of a lesser dimension than said external cross-sectional dimension of said tube to preclude the passage of said tube therethrough.

3. The package of claim 1, wherein said container includes a main body portion connected to a neck portion which terminates in said discharge opening, said socket being disposed in the wall of said neck portion.

4. The package of claim 3, wherein the configuration of said socket in a cross section of said container wall taken orthogonally to a longitudinal axis of said container, defines a retention opening larger than the external cross-sectional dimension of said tube in which said second open end is retained, and a slot providing fluid communication between said retention opening and said discharge opening, said slot being of a lesser dimension than said external cross-sectional dimension of said tube to preclude the passage of said tube therethrough.

5. The package of claim 3, wherein said neck portion includes a grip ring portion thereon and said socket is disposed in said grip ring portion.

6. The package of claim 1, wherein said first open end is an openable sealed end.

7. The package of claim 1, further including a removable cap on said first open end.

8. The package of claim 1, further comprising a frangible closure covering said discharge opening.

9. The package of claim 8, wherein said frangible closure is covered by a removable cap.

10. The package of claim 1, further comprising a recessed wall portion in said closed end of said container, said first open end of said tube being disposed within the confines of said recessed wall portion.

* * * * *